US007716954B2

(12) United States Patent
Naka et al.

(10) Patent No.: US 7,716,954 B2
(45) Date of Patent: May 18, 2010

(54) METHOD FOR PRODUCING TUBULAR KNITTED FABRIC AND WEFT-KNITTING MACHINE

(75) Inventors: Hideki Naka, Wakayama (JP); Tomoyuki Taniguchi, Wakayama (JP); Yoshinori Shimasaki, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 11/886,997

(22) PCT Filed: Mar. 17, 2006

(86) PCT No.: PCT/JP2006/305381

§ 371 (c)(1),
(2), (4) Date: Jul. 31, 2009

(87) PCT Pub. No.: WO2006/103957

PCT Pub. Date: Oct. 5, 2006

(65) Prior Publication Data

US 2009/0314037 A1 Dec. 24, 2009

(30) Foreign Application Priority Data

Mar. 25, 2005 (JP) ..... 2005-088279
Aug. 11, 2005 (JP) ..... 2005-232983

(51) Int. Cl.
*D04B 7/04* (2006.01)

(52) U.S. Cl. ..... 66/64; 66/78

(58) Field of Classification Search ..... 66/60 R, 66/64, 69, 70–78, 62, 67, 68
See application file for complete search history.

(56) References Cited

U.S. PATENT DOCUMENTS

| | | | | | |
|---|---|---|---|---|---|
| 4,474,037 | A | * | 10/1984 | Kuhnert | 66/78 |
| 4,545,219 | A | * | 10/1985 | Schmodde | 66/70 |
| 4,643,003 | A | * | 2/1987 | Schmodde | 66/78 |
| 4,729,230 | A | * | 3/1988 | Schmodde et al. | 66/70 |
| 5,343,719 | A | * | 9/1994 | Nakamori et al. | 66/75.1 |
| 6,125,661 | A | * | 10/2000 | Shima | 66/64 |
| 6,591,430 | B1 | * | 7/2003 | Sledge | 2/468 |
| 7,269,975 | B2 | * | 9/2007 | Miyamoto et al. | 66/78 |
| 7,412,850 | B2 | * | 8/2008 | Yamano | 66/78 |

FOREIGN PATENT DOCUMENTS

| | | |
|---|---|---|
| JP | 2631923 | 4/1997 |
| JP | 2700203 | 10/1997 |
| JP | 3292836 | 3/2002 |

* cited by examiner

*Primary Examiner*—Danny Worrell
(74) *Attorney, Agent, or Firm*—Wenderoth, Lind & Ponack, L.L.P.

(57) ABSTRACT

A needle engaging with a loop at least lastly formed on a fabric formed just before inversion of a carriage is pulled by a pull-down cam formed in a composite cam system of the carriage while feeding a yarn to an opposite needle. When a feeding direction of a yarn fed from a yarn feeder is inverted accompanied with the inversion of the carriage, the tension force applied to the yarn is intensified to prevent tightening of the stitch of the knitted fabric.

7 Claims, 9 Drawing Sheets

METHOD FOR PRODUCING TUBULAR KNITTED FABRIC AND WEFT-KNITTING MACHINE

TECHNICAL FIELD

The present invention relates to a method for producing a tubular knitted fabric with a weft-knitting machine and a weft-knitting machine.

BACKGROUND ART

In general, a circular knitting machine having a needle arranged movably upward on a peripheral surface of a tubular cylinder is used for forming a tubular knitting, for example, socks, gloves and sweaters. The tubular knitting is formed through feeding yarn while controlling the lifting operation of the needle on the peripheral surface of the cylinder.

With the use of the circular knitting machine for producing a tubular knitted fabric, the numbers of wale and the peripheral length are defined by the number of needles and the diameter of the cylinder. In order to form the tubular knitting with different numbers of wale and the peripheral length, the circular knitting machine equipped with various cylinders for the variation is required.

In order to form the tubular knitting with the long peripheral length, the diameter of the cylinder of the circular knitting machine is increased, thus enlarging the entire size of such machine.

The weft-knitting machine having a pair of longitudinally arranged front and rear needle beds with ends of the needles confronting each other, which is allowed to produce tubular knitted fabric of different diameters has been disclosed by the applicant of the present invention.

With the weft-knitting machine, when the carriage reciprocally movable on the needle bed is in the forward stroke, the yarn is fed to the needle of the needle bed to form the fabric at one side, and in the return stroke, the yarn is fed to the needle of the other needle bed such that the yarn for forming the fabric at one side is continued to form the fabric at the other side as shown in FIG. 5. The aforementioned fabric-forming course is repeatedly performed alternately to produce a tubular knitted fabric having both ends connected.

In the aforementioned case, upon transition from one needle bed to the other, the direction of the tension applied to the fed yarn changes as shown in FIG. 5. The needle of the needle bed at the edge of the fabric is likely to be pulled out. Once the needle is pulled out, the resultant loop becomes small.

The small loop may deteriorate quality of the tubular knitted product.

In order to cope with the aforementioned problem, the applicant of the present invention has proposed the art for producing a tubular knitted fabric using the weft-knitting machine equipped with a pair of needle beds arranged longitudinally, which allows the carriage to reciprocally move to connect both end portions of the fabric with the needle of the respective needle beds for producing the tubular knitted fabric. When the carriage is in the forward stroke where the needle is controlled to advance by the control cam for forming the knitted fabric, the needle advance preventing unit provided at both ends and/or closed to both ends is released to allow the needle to advance. When the carriage is in the return stroke, the needle advance preventing unit is enabled to allow the needle at both ends and/or close to both ends of the fabric to only retract (Patent Document 1).

Patent Document 1: Laid open Japanese Patent Application (Unexamined) Publication No. 86561/1993

DISCLOSURE OF INVENTION

Besides the fabric forming mechanism, the aforementioned method requires a large control mechanism including the needle advance preventing unit provided to the rear end of the needle for preventing advancement of the needle at both side ends of the fabric, and the release unit provided to the carriage for controlling the needle advance preventing unit. Provision of the needle advance preventing unit and the control mechanism makes the structure complicated and increases the cost.

The needle advance preventing unit has to be moved for changing the knitting width of the fabric. The setting or adjustment for the aforementioned operation requires extra efforts.

An object of the present invention is to provide a weft-knitting machine capable of forming a high quality knitting product with uniform loop length at low costs, and a method for producing a tubular knitted fabric.

The object of the invention can be performed by a method for producing a tubular knitted fabric with a weft-knitting machine having at least one pair of front and rear needle beds disposed both upper end portions thereof confronting each other at a distance, at least one pair of carriages each one of which is arranged to slide and reciprocate laterally on the respective needle beds, and a composite cam system installed in each carriage, wherein the needle being selected from a plural needles mounted in the respective needle beds, is raised and lowered through a composite cam system mounted in the respective carriages for producing a tubular knitted fabric while each carriage being moved reciprocally along the respective needle beds. The method according to the present invention is principally characterized in that when a knitting course of the knitted fabric being progressed after inversion of the carriage, the needle engaging with at least a lastly formed loop in the knitted fabric on one of the needle beds just before the inversion of the carriage, is kept from advancing towards the upper portion of the needle bed by means of a stitch cams incorporated into the composite cam system, while on the other needle bed, a knit yarn is fed to a needle opposing to the needle engaged with the last formed loop for forming a continuous loop with the last formed loop.

In the method for forming the tubular knitted fabric with the weft-knitting machine according to the present invention, the needle engaging with at least a lastly formed loop in the knitted fabric on one of the needle beds just before the inversion of the carriage is pulled back to the needle bed by means of a stitch cams of the composite cam system installed into the carriage, while on the other needle bed, a knit yarn is fed to a needle opposing to the needle engaged with the last formed loop for forming a continuous loop with the last formed loop. In the method, the needle engaging with at least a lastly formed loop in the knitted fabric on one of the needle beds just before the inversion of the carriage is kept from advancing towards the upper portion of the needle bed by means of a following one of stitch cams of the composite cam system installed into the carriage so that, on the other needle bed, a needle opposing to the needle engaged with the last formed loop before forming a continuous loop with the last formed loop is pulled by a pull-down cam at a forward position.

Further, in the method for producing the tubular knitted fabric with the weft-knitting machine according to the present invention, the pull-down cam is composed of a needle raising cam in the composite cam system, and the pull-down cam is composed of a preceding one of stitch cams in the composite cam system.

The weft-knitting machine according to the present invention, comprises at least one pair of front and rear needle beds disposed confronting each other at a distance, at least one pair of carriages each one of which is arranged to slide and reciprocate laterally on the respective needle beds, and a composite cam system installed in each carriage, wherein the needle being selected from a plural needles mounted in the respective needle beds, is raised and lowered through a composite cam system mounted in the respective carriages for producing a tubular knitted fabric with feeding a knit yarn to the needles of the needle beds cyclically, while each carriage being moved reciprocally along the respective needle beds. In the weft-knitting machine, a pull-down cam is incorporated into a needle raising cam of each composite cam system for pulling down the needle engaging with at least a lastly formed loop in the knitted fabric on one of the needle beds just before inversion of the carriage for progressing a knitting course of the knitted fabric subsequent to the inversion of the carriage.

EFFECT OF THE INVENTION

In the present invention, the needle engaging with at least a lastly formed loop in the knitted fabric on one of the needle beds just before the inversion of the carriage is pulled back to the needle bed by means of a stitch cams of the composite cam system installed into the carriage. The needle engaging with the loop lastly formed is not pulled out. Unlike already known type of the weft-knitting machine, the loop hooked with the needle hardly becomes small. This makes it possible to provide a more quality tubular knitted fabric with uniform loop length.

In the present invention, the push-down cam for the needle is formed in the composite cam system installed into the carriage. Unlike the one as has been proposed by the applicant of the present invention, the enlarged control mechanism including the needle advance preventing unit for preventing the needle at both side ends of the fabric from advancing, and the release unit provided in the carriage for controlling the needle advance preventing unit does not have to be provided, resulting in the simple structure produced at lower costs.

In the present invention, the push-down cam for the needle is formed in the composite cam system installed into the carriage. The needle advance preventing unit does not have to be moved for changing the stitch width of the knitted fabric. The productivity may be improved by saving efforts for the setting and the adjustment.

The method for producing a tubular knitted fabric using a weft-knitting machine having a pull-down cam composed of a preceding one of stitch cams in the composite cam system can be easily performed with the existing weft-knitting machine.

By use of a weft-knitting machine having the pull-down cam composed of a needle raising cam in the composite cam system installed into the carriage, the present invention can be easily realized without largely changing the carriage.

BEST MODE FOR CARRYING OUT THE INVENTION

Figure 1:
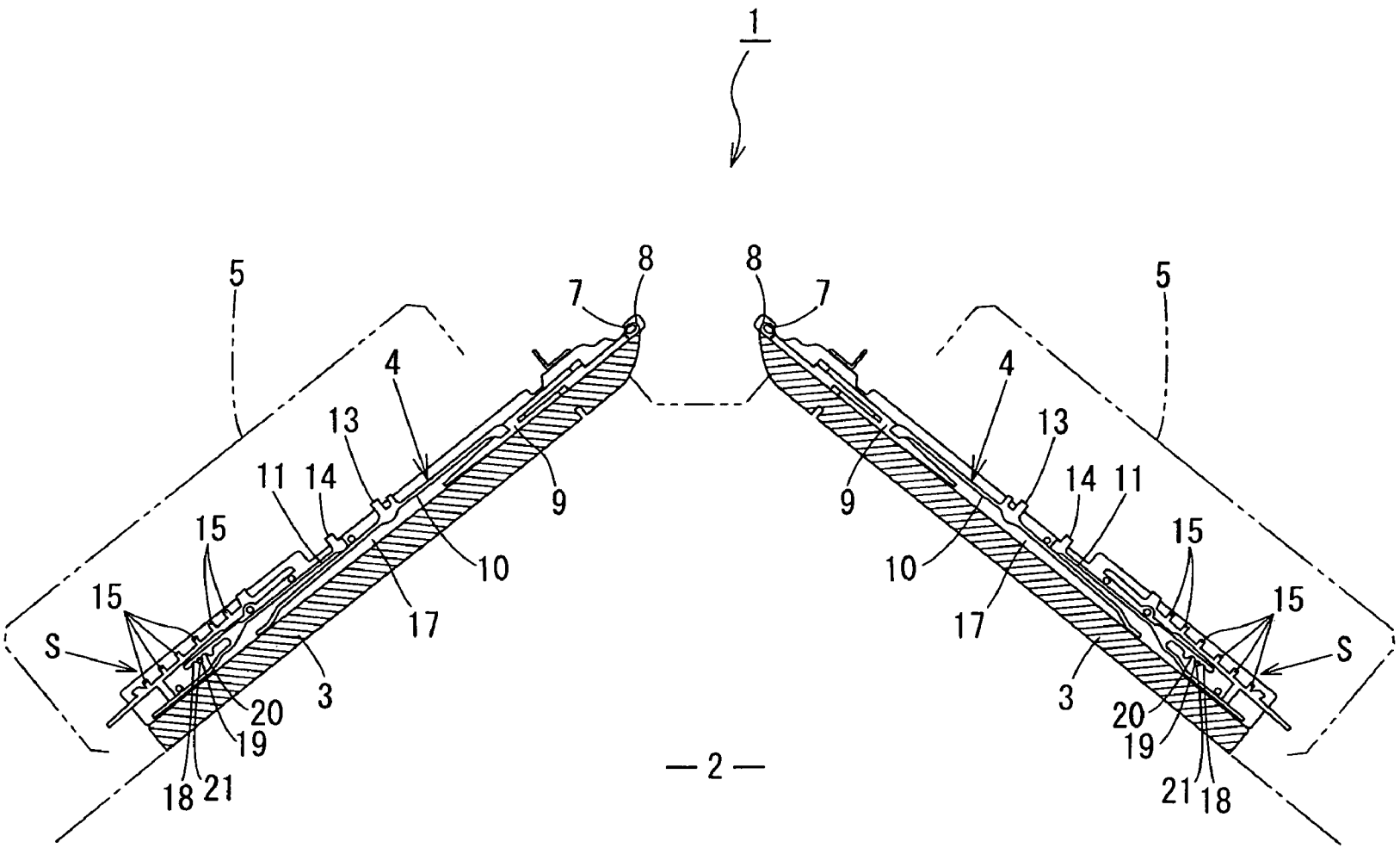
FIG. 1 is a longitudinal sectional view showing needle beds of a weft-knitting machine for realizing a method for producing a tubular knitted fabric according to a first embodiment of the present invention.

Preferred embodiments of a method for producing a tubular knitted fabric with a weft-knitting machine and a weft-knitting machine according to the present invention are described in detail referring to the drawings.

Example 1

As shown generally in FIG. 1, an essential portion of the weft-knitting machine has a pair of longitudinally arranged front and rear needle beds. A numerical reference 1 denotes a needle bed portion of the weft-knitting machine as a whole.

The needle bed portion 1 includes needle beds 3, 3 both of which are reverse-V like arranged having each end portion confronting each other on the upper surface of a frame 2. A large number of needles 4, 4 . . . are provided in the upper surface of the respective needle beds 3, 3 so as to be raised and lowered sliding.

Only the needle 4 selected by a needle selection mechanism S (described later) is subjected to the lifting control by a composite cam system 6 (see FIG. 2) installed in a carriage 5.

The needle 4 is formed by arranging a needle body 9 having a hook 8 with a latch 7 at the tip, a needle jack 10 linked to a rear end of the needle body 9, and a selector jack 11 at an upper rear portion of the needle jack 10 in the aforementioned order.

Butts 13 and 14 protrude from the respective upper surfaces of the needle jack 10 and the selector jack 11 so as to allow the composite cam system 6 of the carriage 5 to lift up each selected needle in the respective needle groove 17 provided in the needle beds 3, 3.

In the needle selection mechanism S, selector butts 15 are provided on the upper surface of the selector jack 11 of the respective needles 4, 4 . . . , where each of the adjacent needles has a different phase in the lifting direction of the needle. As an actuator 33 (see FIG. 2) provided in the carriage 5 is activated, the butt 14 for the needle 4 of the activated selector butt 15 is lifted in the needle groove 17 of each of the needle beds 3, 3 by the composite cam system 6 of the carriage 5.

Recess portions 18, 19 and 20 are formed in the lower surface at the rear of the selector jack 11 for each of the needles 4. One of the recess portions 18, 19 and 20 will be selectively hooked with a wire 21 which passes through the needle bed 3. If the wire 21 is hooked with the recess portion 20, a welt position is held. If it is hooked with the recess portion 19, a knit position is held. If it is hooked with the recess portion 18, a tuck position is held.

Figure 2:
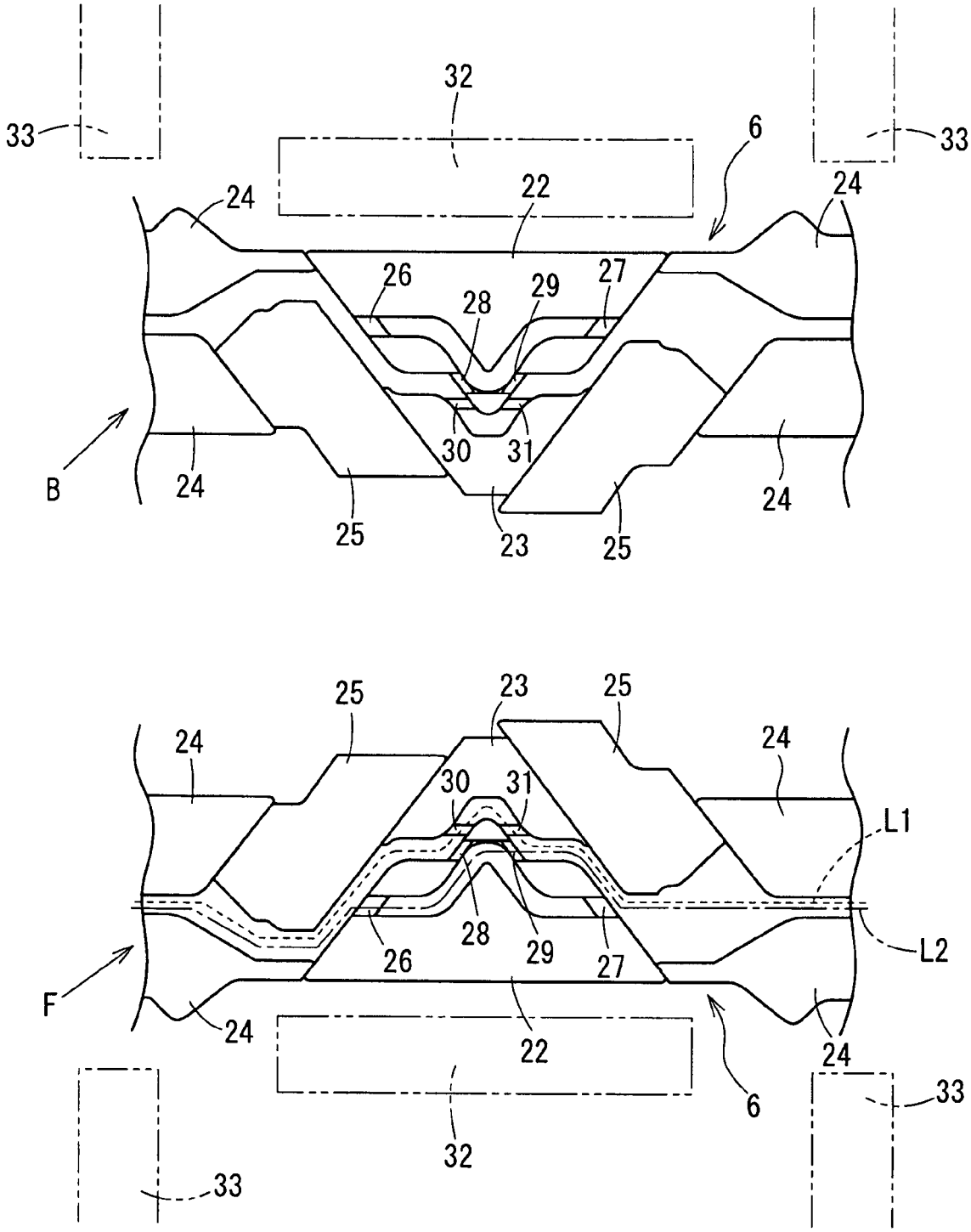
FIG. 2 is a perspective view schematically showing a composite cam system of a carriage in the weft-knitting machine for the method for producing a tubular knitted fabric according to the first embodiment of the present invention.

The composite cam system 6 of the carriage 5 which slides on the respective needle beds 3 to lift up the selected needle 4 has the structure as shown in FIG. 2.

Referring to FIG. 2 as a perspective view of the composite cam system of the carriage 5 which moves sliding on the respective needle beds 3 seen from the above, a code F denotes the composite cam system 6 of the front carriage 5, and a code B denotes the composite cam system 6 of the rear carriage 5.

The composite cam system 6 of the carriage 5 includes a top cam 23 at the top portion of the needle raising cam 22, a pair of upper and lower fixing guide cams 24 at both sides of the top cam 23, and stitch cams 25 interposed between the top cam 23 and the fixing guide cam 24 so as to be enable to lift up towards upper end portion of the needle bed.

The stitch cam 25 is activated by a stepping motor driven in accordance with a signal indicating the lifting amount set in the program stored in a control unit (not shown).

The stitch cam 25 includes a leading stitch cam 25*a* at the downstream side with respect to the forward movement of the carriage 5, and a following stitch cam 25*b* at the upstream side. The following stitch cam 25*b* is mainly operated for forming the fabric.

A needle route (knit route) L1 for forming the loop is formed, as shown in FIG. 2, between the top cam 23 and the needle raising cam 22 in the composite cam system 6 of the carriage 5 on the needle bed 3 at the front side (F) as well as a groove for forming another needle route L2 being formed in the same one, and further, in the said composite cam system 6, six route selector cams 26, 27, 28, 29, 30 and 31 are provided.

Each of the aforementioned route selector cams 26 to 31 installed in the carriage 5 is raised and set by a not shown solenoid. In these ways, such needle routes L1 and L2 and so on according to the design requirements can be formed by displacing some selected route selector cams.

The selected needle 4 is guided to move vertically along the needle route L1 or L2 in the needle groove 17 of the needle bed 3.

A needle presser 32 (not shown in detail) is provided below the needle raising cam 22 corresponding to the selector butt 15 held at the welt position, knit position and tuck position, and actuators 33 for the needle selection mechanism S are provided at left and right sides of the needle presser below the fixing cams 24.

Figure 3:
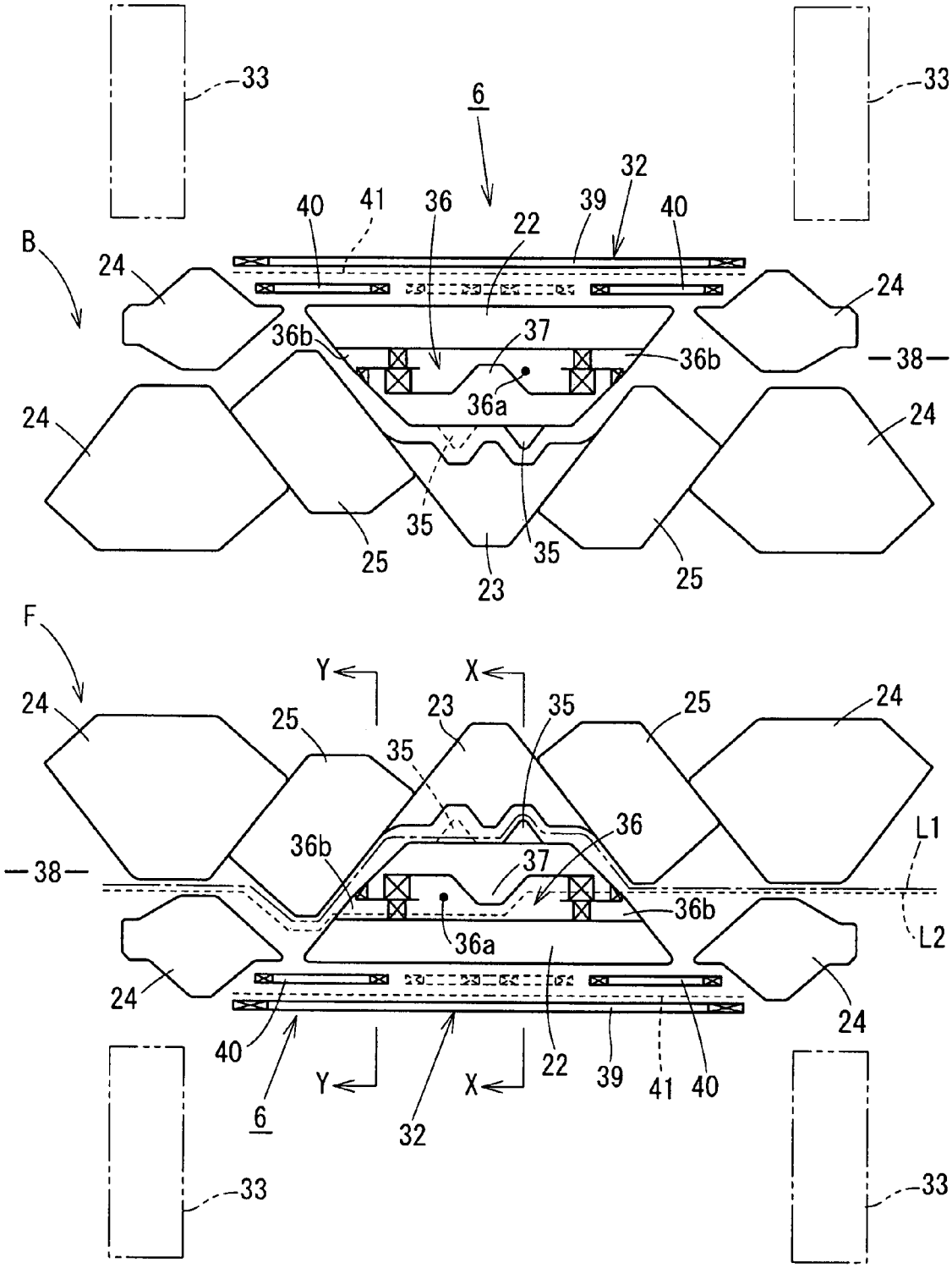
FIG. 3 is a perspective view showing the route through which the needle passes in the forward stroke of the carriage of the weft-knitting machine according to the first embodiment of the present invention.
Figure 5:
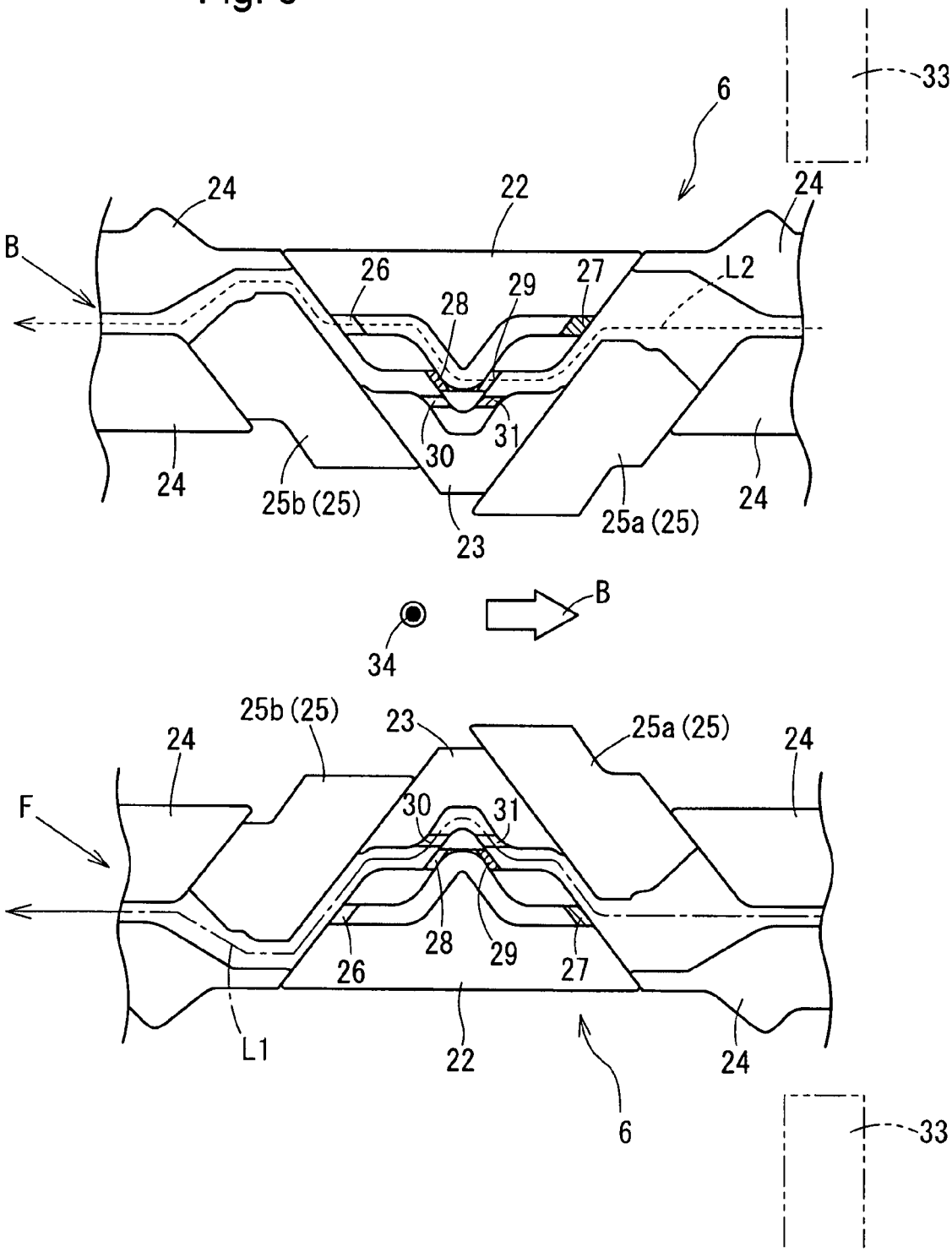
FIG. 5 is a view for explaining the cyclic fabric formation.

The method for producing the tubular knitted fabric according to the present invention using the above-structured weft-knitting machine will be described hereinafter. In the method for producing the tubular knitted fabric, the direction of the knitting cycle is set to counterclockwise as shown in FIG. 5. FIG. 3 shows the forward stroke of the carriage 5 sliding from the right to the left as arrow A indicates while feeding a knitting yarn to the needle 4 of the rear needle bed 3 through a yarn feeder 34 to form the loop.

In the forward stroke, the carriage 5 which has finished knitting with the front needle bed 3 is inverted to slide from the right to the left for forming the fabric with the rear needle bed 3.

In the forward stroke, the route selector cams 26 and 28 of the rear carriage 5 protrude to block the passage. The needle 4 selected by the actuator 33 of the leading needle selection mechanism S as the one in the knitting area of the fabric passes the needle route L1 as indicated by a chain line shown in the drawing.

In the state where the route selector cams 26, 29 and 30 of the front carriage 5 protrude to block the passage, the needle 4 of the front needle bed 3 which is selected by the actuator 33 of the leading needle selection mechanism S and hooks the loop N shown at the right side of FIG. 5 passes the needle route L2 as indicated by the dotted line in FIG. 3.

While the needle 4 of the rear needle bed 3 is raised by the needle raising cam 22 of the composite cam system 6 in the rear carriage 5 to the knit position, the needle 4 of the front needle bed 3 moving along the needle route L2 is pushed up to be adjacent to the portion below the top cam 23.

As the selected needle 4 of the rear needle bed 3 moves down to the intermediate position of the horizontal lower end of the top cam 23, the yarn is fed from the yarn feeder 34. The needle 4 of the front needle bed 3 moving along the needle route L2 guided by the route selector cam 29 has been already moved downwardly. Accordingly, the yarn fed from the yarn feeder 34 is not hooked, i.e. engaged with the needle 4 of the front needle bed 3.

When the needle of the rear needle bed 3 is further pulled by the rear angle 25*b*, the previous loop formed in the previous course knocks over the hook 8 to form a new loop.

Upon transition of knitting from the front needle bed 3 to the rear needle bed 3 resulting from inversion of the carriage 5 in the forward stroke, the needle 4 engaging with the loop (N at the right side of FIG. 5) lastly formed on the fabric formed by the front needle bed 3 just before inversion of the carriage 5 is pulled down by the lower end of the following stitch cam 25*b* of the front carriage 5 until the yarn is fed to the needle 4 of the opposite rear needle bed 3 to form the loop. Accordingly, the needle 4 of the front needle bed 3 is not pulled out.

This may suppress tightening of the loop stitch (N in the right side of FIG. 5).

Figure 4:
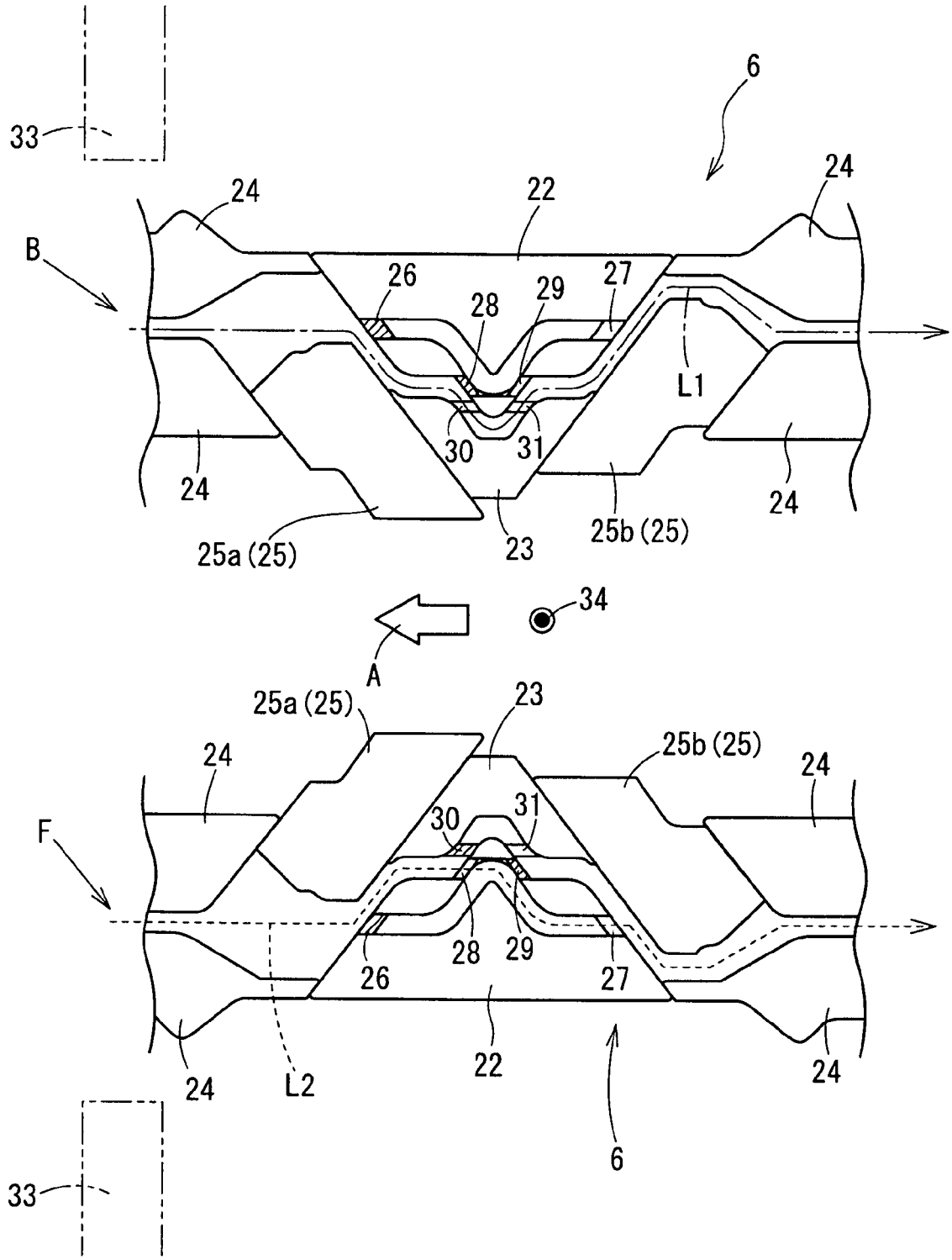
FIG. 4 is a perspective view showing the route through which the needle passes in the return stroke of the carriage of the weft-knitting machine according to the first embodiment of the present invention.

Upon termination of knitting by the rear needle bed 3 to be out of the knitting area (upper left of the drawing), the carriage 5 is inverted to slide from the left to the right for forming the fabric with the front needle bed, that is, in the return stroke as shown in FIG. 4.

In the return stroke shown in FIG. 4, as the route selector cams 27 and 29 of the front carriage 5 protrude to block the passage, the needle 4 selected by the actuator 33 of the leading needle selection mechanism S on the knitting area passes the needle route L1 as indicated by the chain line. As the route selector cams 27, 28 and 31 of the rear carriage 5 protrude to block the passage, the needle 4 of the rear needle bed 3 which is selected by the actuator 33 of the leading needle selection mechanism S, and hooks the loop N at the left side of FIG. 5 passes the needle route L2 as indicated by the dotted line.

After the carriage 5 is inverted, and the front needle bed 3 is operated for forming the fabric, the needle 4 of the front needle bed 3 opposite the needle 4 engaging with the loop (N at the left of FIG. 5) lastly formed on the fabric by the rear needle bed 3 is selected by the actuator 33 of the leading needle selection mechanism S of the front carriage 5. While the selected needle is raised to the knit position by the needle raising cam 22 in the composite cam system 6 of the front carriage 5, the needle 4 of the rear needle bed 3 passing the needle route L2 is pushed up to be adjacent to the portion below the top cam 23.

The needle 4 of the front needle bed 3 moves down to the intermediate position of the horizontal lower end of the top cam 23 such that the yarn is fed from the yarn feeder 34. At this time, the needle 4 of the rear needle bed 3 guided by the route selector cam 28 has been already moved down. The fed yarn is not hooked by the needle 4 of the rear needle bed 3 in the same way as in the forward stroke.

When the needle 4 of the front needle bed 3 is further pulled by the following stitch cam 25*b*, the previous loop formed in the previous course is knocked over to form a new loop.

When the needle 4 of the front needle bed 3 is pulled by the following stitch cam 25*b*, the needle 4 (needle at the end of the fabric in the course lastly formed by the rear needle bed 3 of the opposite rear needle bed 3 is pulled by the following stitch cam 25*b*.

Accordingly, the needle 4 of the rear needle bed 3 is not pulled out, thus suppressing tightening of the stitch of the loop (N in the left side of FIG. 5).

When the knitting with the front needle bed 3 is finished to be out of the knitting area (upper right of the drawing), the carriage 5 is inverted again to slide from the right to the left for forming the fabric with the front needle bed 3, that is, in the forward stroke.

The knitting operations in the forward and return strokes are alternately performed continuously.

As the aforementioned operations are repeatedly performed at both ends of the fabric, the loop 4 at the portion where the carriage 5 is inverted is not tightened to become small even in the case where the tubular knitted fabric is formed with the weft-knitting machine by cyclically feeding the yarn to the needle of the front and rear needle beds 3.

In the embodiment, while the needle engaging with at least one terminal loop formed just before inversion of the carriage is guided to the needle route L2 and the needle 4 of the needle bed 3 opposite the aforementioned needle forms the loop, the stitch cam 25*b* prevents the needle 4 from being pulled out by operating the needle selection mechanism S and the route selector cams 26 to 31 in the needle raising cam 22.

The needle presser may be structured to apply pressure to the needle for the period until the butt of the needle selected in corporation with the needle selection mechanism S and the needle presser 32 for forming the loop at the end reaches the following stitch cam 25*b* such that the needle passes without receiving the function of the needle raising cam. Thereafter, the pressure applied from the needle presser is released such that the needle is pulled by the following stitch cam 25*b*.

In the aforementioned case where the needle passes the route different from the needle route L2, the needle may be prevented from being pulled up as well.

The amount of pulling the needle 4 engaging with the loop at the end of the fabric knitted just before the inversion may be arbitrarily set so long as the needle is kept from being pulled out. The device used for the aforementioned purpose is not necessarily the one for pulling the needle out.

In the embodiment, while the yarn is fed to the needle 4 opposite the one engaging with the loop of the fabric knitted just before the inversion of the carriage 5, the single needle 4 opposite the one at the end of the fabric is pulled by the stitch cam 25*b*. Alternatively a plurality of needles at the side end may be pulled.

Example 2

In the knitting machine according to the present embodiment, after performing one course for forming the tubular knitted fabric, the carriage is inverted to the other course for knitting. The knitting machine is provided with the operation cam in the needle raising cam of the composite cam system for pulling down the needle engaging with the loop formed just before the inversion prior to the formation of the loop on the other fabric.

Although the detailed view of the weft-knitting machine is omitted, it has the structure substantially the same as that of the first embodiment except the use of the composite needle for opening and closing the hooked portion through lifting of the slider, and the composite cam system of the carriage to be described later referring to FIG. 6.

Figure 6:
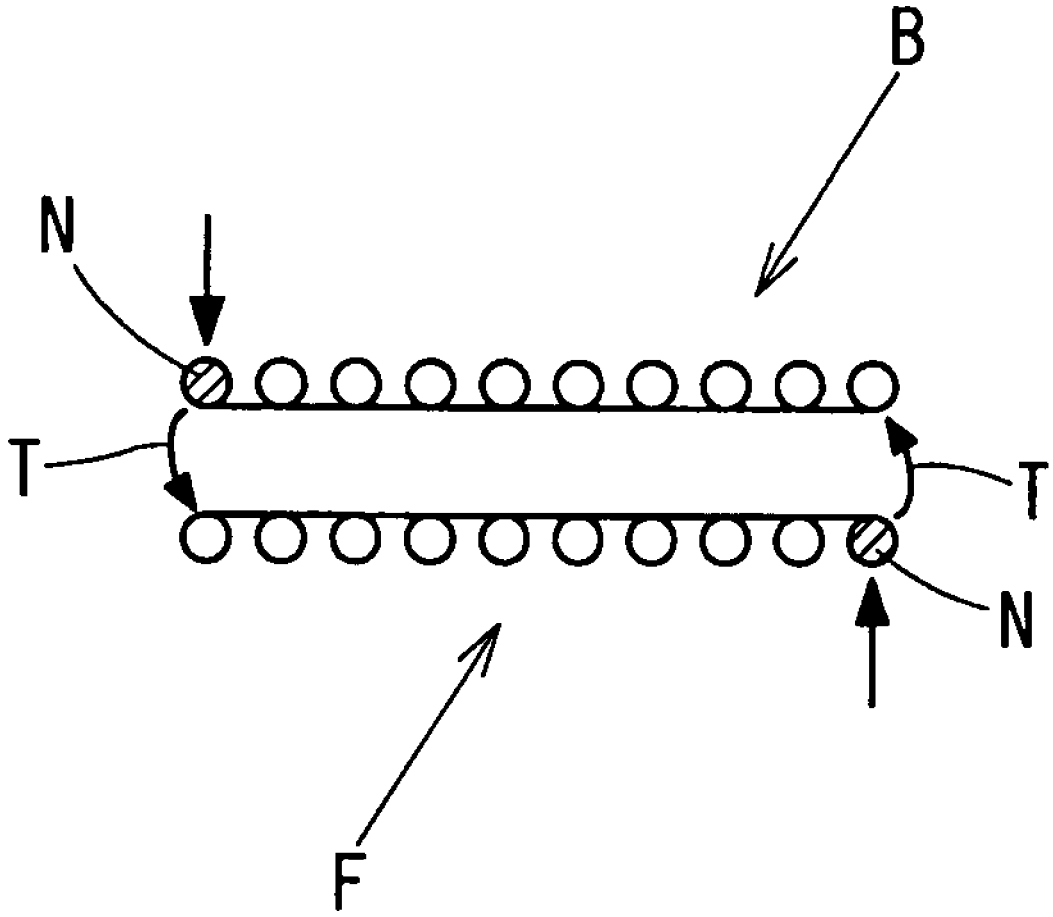
FIG. 6 is a perspective view showing the method for producing a tubular knitted fabric and the composite cam system of the carriage for realizing the weft-knitting machine according to a second embodiment of the present invention.

Referring to FIG. 6, the composite cam system 6 of the carriage 5 is provided with the top cam 23 above the needle raising cam 22, and a pair of upper and lower fixing guide cams 24 at both sides of the top cam 23 (at the front and rear sides in the forward direction of the carriage). The stitch cams 25 are interposed between the top cams 23 and the fixing guide cams 24 so as to be enable to lift up.

The lifting operation of the stitch cam 25 is performed by the stepping motor driven in accordance with the lift amount signal set in the program stored in the control unit (not shown).

The stitch cam 25 includes the leading stitch cam 25*a* at the downstream side of the forward direction of the carriage 5, and the following stitch cam 25*b* at the upstream side. During the knitting operation, the following stitch cam 25*b* may be used for setting the stitch size.

The needle route L1 (knit route) for forming the loop is formed, as shown at the lower side in FIG. 6, between the top cam 23 and the needle raising cam 22 in the composite cam system 6 of the carriage 5 on the needle bed 3 at the front side (F), and another needle route L2 (control route) is formed in the needle raising cam 22.

The needle route L1 as the knit route is formed such that two triangular projecting/retreating cams 35 which are longitudinally arranged symmetrical with respect to the center line passing through the top portion of the top cam 23 are provided on the upper surface of the trapezoidal needle raising cam 22. The projecting/retreating cam at the leading side protrudes in accordance with the signal from the program stored in the control unit (not shown) during the knitting operation.

Meanwhile, the needle route L2 in the needle raising cam 22 forms a passing through passage 36 at the height intermediate of that of the needle raising cam 22 such that the inner portion 36*a* of the passage 36 is widened upward and an operation cam 37 with downward trapezoidal shape integrally formed with the needle raising cam 22 is provided at the inner portion 36*a* as a pull-down cam.

Figure 7:
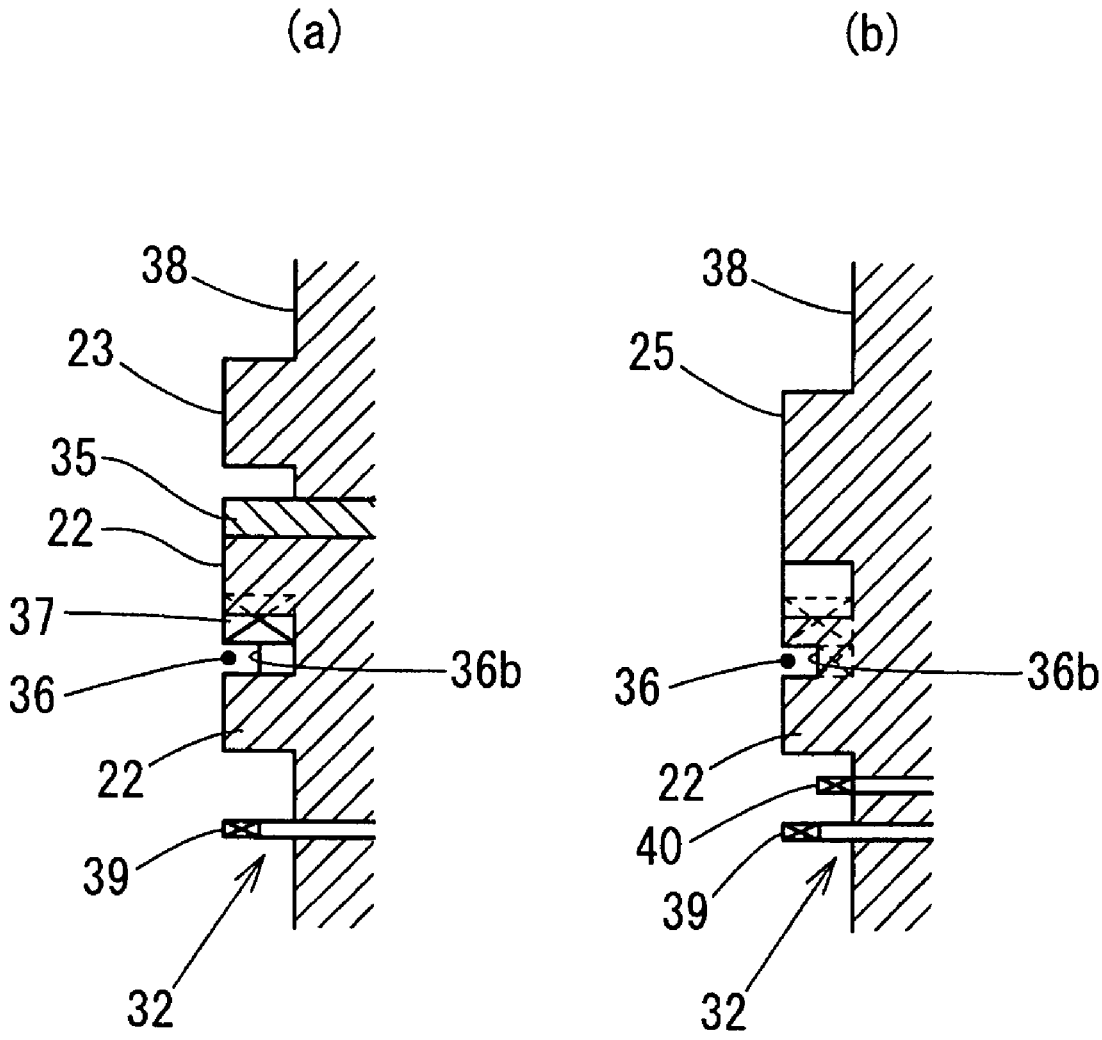
FIG. 7 shows sectional views taken along lines X-X and Y-Y shown in FIG. 6 according to the second embodiment of the present invention.

FIG. 7 shows the height of the needle route L2 in the needle raising cam 22.

FIG. 7(*a*) is a sectional view taken along line X-X of FIG. 6, and FIG. 7(*b*) is a sectional view taken along line Y-Y of FIG. 6, respectively. Each height of the needle raising cam 22, the stitch cam 25 and the protruding projecting/retreating cam 35 is set to be the same. The inner portion 36*a* of the passage 36 has the same level (0) as that of the bottom board 38 (substantially on the same plane), and the longitudinal port 36*b* of the passage 36 is set to be at the intermediate position (half the height) half the height between the needle raising cam 22 and the bottom board 38.

When the selector butt 15 of the needle 4 selected by the actuator 33 on the knitted area receives the function of the needle presser 32, it is determined whether the needle passes the needle route L1 for forming the loop or the needle route L2 for controlling the route.

The needle presser 32 includes a welt presser 39 which is long enough to cover the operation range of the front and rear stitch cams 25*a*, 25*b*, and a half presser 40 with the half height which is retractably formed on the portion corresponding to the longitudinal port 36*b* above the welt presser 39. Assuming that the half presser 40 is set to the position A, and the welt presser 39 is set to the position B, a half (H) position is formed at the intermediate position between these positions as indicated by the dotted line 41 in FIG. 6.

When the half presser 40 as the position A is set at substantially the same level as the bottom board 38 (height: 0), and the selector butt 15 of the needle 4 is at the half position as indicated by the dotted line 41, that is, when the needle 4 selected by the actuator 33 is not subjected to the function of the needle presser 32, the needle 4 passes the needle route L1 as the knit route. When the needle 4 is subjected to the function of the half presser 40 at the position A, the needle 4 passes the needle route L2 as the control route.

When the selector butt 15 of the needle 4 is subjected to the function of the welt presser 39 at the position B, the needle 4 is allowed to pass without being subjected to the function of the composite cam system 6 of the carriage 5.

Figure 8:
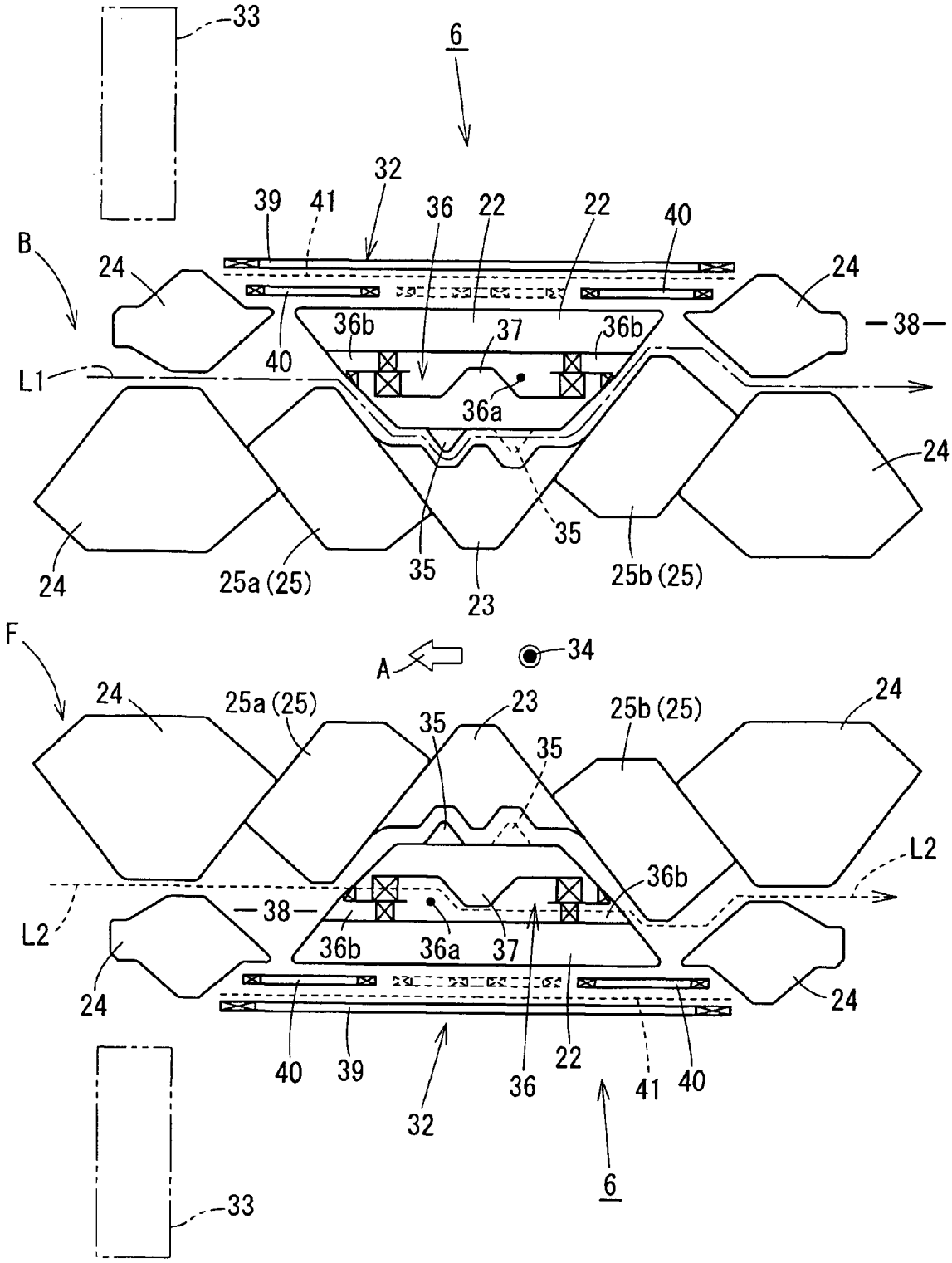
FIG. 8 is a perspective view showing the route through which the needle is guided to move in the forward stroke of the carriage according to the second embodiment of the present invention.

The method for producing the tubular knitted fabric using the above-structured weft-knitting machine according to the present invention will be described. Likewise the first embodiment, in the method for producing the tubular knitted fabric, the cyclic direction of knitting is set to counterclockwise as shown in FIG. 5. FIG. 8 shows the forward stroke where the loop is formed by the carriage 5 sliding from the right to the left as indicated by the arrow A to feed the yarn to the needle 4 of the rear needle bed 3 from the yarn feeder 34.

In the forward stroke, the carriage 5 which has finished knitting by the front needle bed 3 is inverted to slide from the right to the left such that the fabric is formed by the rear needle bed 3.

In the forward stroke, as the projecting/retreating cam 35 at the leading side of the rear (B) carriage 5 protrudes, the selector butt 15 of the needle 4 of the rear needle bed 3 selected by the leading needle selection mechanism S is not subjected to the function of the needle presser 32. The butt 13 of the needle 4 is subjected to functions of the needle raising cam 22 and the projecting/retreating cam 35 to pass the needle route L1 as the knit route as indicated by the chain line of FIG. 8.

Meanwhile, the needle 4 of the front needle bed 3, engaging with the loop N at the right side shown in FIG. 5 is selected by the leading needle selection mechanism S of the front carriage 5. The butt 13 of the selected needle 4 is pushed into the half position (intermediate height) upon reception of the function of the half presser 40.

The butt 13 of the needle 4 passes the needle route L2 as the control route indicated by the dotted line in the passage 36 formed in the needle raising cam 22 of the composite cam system 6 of the front (F) carriage 5 as shown in FIG. 8.

While the needle 4 of the rear needle bed 3 moves up to the knit position by means of the needle raising cam 22 of the composite cam system 6 of the rear (B) carriage 5 and the projecting/retreating cam 35, the needle 4 of the front needle bed 3 passing the needle route L2 in the composite cam system 6 of the front (F) carriage 5 is pulled down by the operation cam 37 serving as the pull-down cam of the needle.

The yarn is fed from the yarn feeder 34 when the selected needle 4 of the rear needle bed 3 moves down to reach the intermediate position on the horizontal portion at the lower end of the top cam 23.

The needle 4 of the front needle bed 3 which passes the needle route L2 guided by the passage 36 of the front (F) carriage 5 has been moved down by the operation cam 37 as the pull-down cam. In the aforementioned state, when the needle 4 of the rear needle bed 3 is further pulled by the following stitch cam 25*b*, the hook portion of the previous loop formed in the previous course is knocked over to form the new loop.

During fabric formation in the forward stroke, when the carriage 5 is inverted from the front needle bed 3 to the rear needle bed 3 for forming the fabric, the needle 4 engaging with the loop (N at the right side of FIG. 5) lastly formed on the fabric by the front needle bed 3 just before inversion of the carriage 5 has been pulled down by the operation cam 37 of the front (F) carriage 5 before feeding the yarn to the needle 4 of the opposite rear needle bed 3 for forming the fabric. The tension force applied to the yarn is intensified upon inversion of the yarn feeding direction of the yarn feeder 34 accompanied with the inversion of the carriage 5. Even if the yarn is pulled out from the loop formed just before the inversion to tighten the loop, the tightening of the loop may be corrected to make the loop length of the fabric uniform.

As the needle has been pulled down by the following stitch cam 25*b* of the front (F) carriage 5 while the yarn is fed to the needle 4 of the rear needle bed 3 for forming the fabric, the needle 4 of the front needle bed 3 is not pulled out when the needle 4 of the rear needle bed 3 is pulled by the stitch cam 25*b*.

This may prevent the stitch of the loop (N in the right side of FIG. 5) from being tightened.

Figure 9:
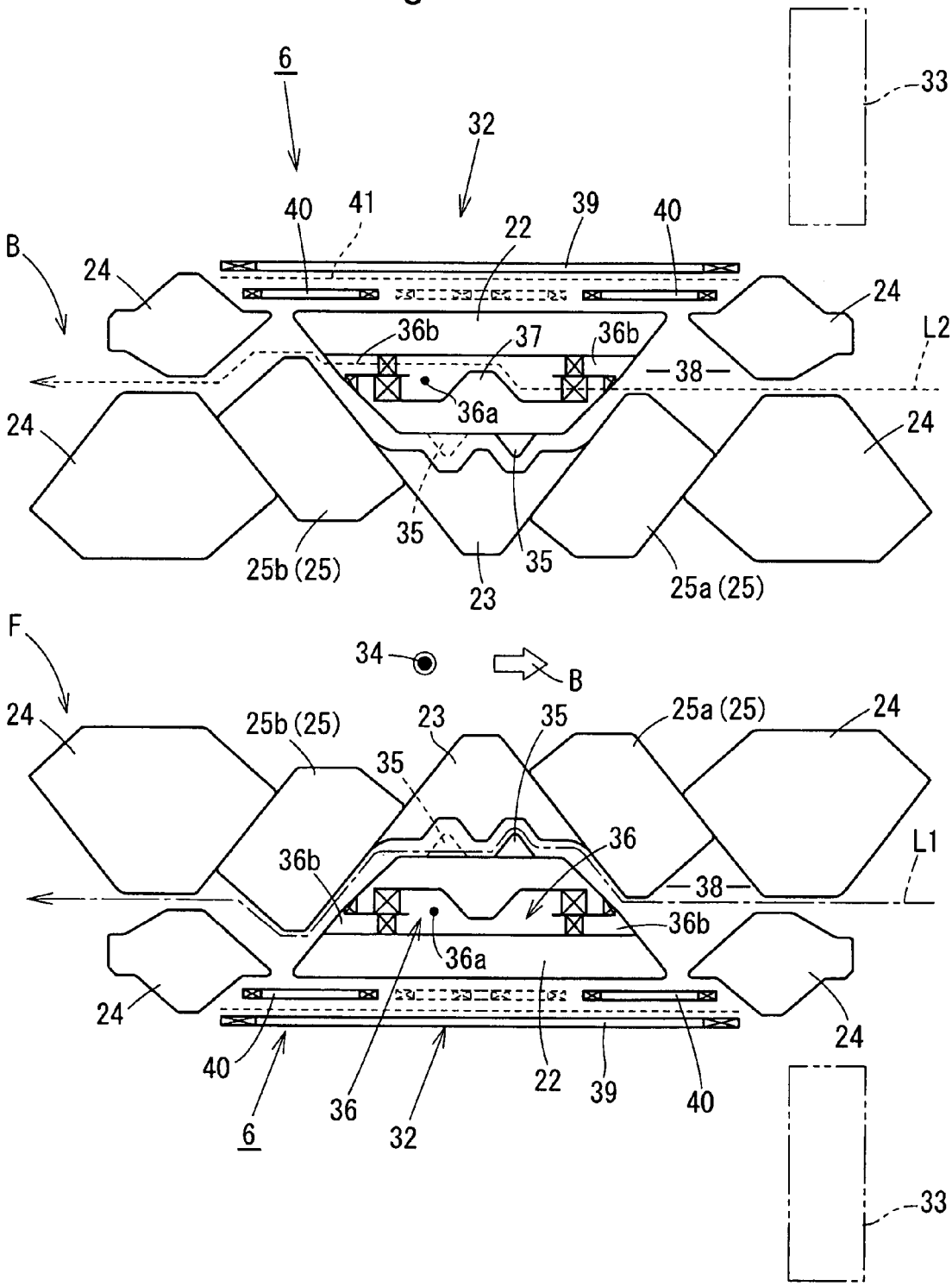
FIG. 9 is a perspective view showing the route through which the needle is guided to move in the return stroke of the carriage according to the second embodiment of the present invention.

When the fabric formation with the rear needle bed 3 has been finished to be out of the knitting area (leftward in the drawing), the carriage 5 is inverted to slide from the left to the right as indicated by the arrow B of FIG. 9 for forming the fabric with the front needle bed 3 in the return stroke.

In the return stroke shown in FIG. 9, the projecting/retreating cam 35 at the leading side of the front (F) carriage 5 protrudes. The selector butt 15 of the needle 4 selected by the actuator 33 of the needle selection mechanism S at the leading side is not subjected to the function of the needle presser 32, and the butt 13 of the needle 4 is subjected to functions of the needle raising cam 22 and the projecting/retreating cam 35. Then the needle passes the needle route L1 as the knit route in the composite cam system 6 of the front (F) carriage 5 shown in FIG. 9 as indicated by the chain line.

Meanwhile, the needle 4 of the rear needle bed 3, engaging with the loop N at the left side of FIG. 5 is selected by the actuator 33 of the needle selection mechanism S at the leading side of the rear carriage 5. The butt 13 of the selected needle 4 is subjected to the function of the half presser 40 to be pushed to the half position.

Then referring to FIG. 9, the butt 13 of the needle 13 passes the needle route L2 as the control route formed in the passage 36 in the needle raising cam 22 within the composite cam system 6 of the rear carriage 5 as indicated by the dotted line.

While the needle 4 of the front needle bed 3 is moved up to the knit position by the needle raising cam 22 and the projecting/retreating cam 35 on the needle route L1 as the knit route in the composite cam system 6 of the front carriage 5, the needle 4 of the rear needle bed 3 passing the needle route L2 is pulled down by the operation cam 37 serving as the pull-down cam of the needle.

When the selected needle 4 of the front needle bed 3 moves down from the tip of the projecting/retreating cam 35 to reach the intermediate position on the horizontal portion at the lower end of the top cam 23, the yarn is fed from the yarn feeder 34.

The needle 4 of the rear needle bed 3 moving along the needle route L2 guided by the passage 36 of the rear (B) carriage 5 has been pulled down by the operation cam 37 as a pull-down cam. When the needle 4 of the front needle bed 3 is further pulled by the following stitch cam 25*b*, the hooked portion of the preceding loop formed in the preceding knitting courses is knocked over to form the new loop.

In the return stroke for forming the knitted fabric, when the carriage 5 is inverted from the rear needle bed 3 to the front needle bed 3 for forming the knitted fabric, the needle 4 engaging with the loop (N in the left side of FIG. 5) lastly formed in the knitted fabric on the rear needle bed 3 just before the inversion of the carriage 5 has been pulled down by the operation cam 37 of the rear (B) carriage 5 before feeding the yarn to the needle 4 of the opposite front needle bed 3, the tension force applied to the yarn is intensified upon inversion of the yarn feeding direction from the yarn feeder 34 accompanied with the inversion of the carriage 5. As a result, the length of the loop in the knitted fabric may be made uniform by correcting tightening of the loop resulting from pulling out of the yarn from the loop formed just before the inversion of the carriage 5.

While the yarn is fed to the needle 4 in the front needle bed 3 for forming the knitted fabric, it has been pulled down by the stitch cam 25*b* at the following side of the rear (B) carriage 5. When the needle 4 of the front needle bed 3 is pulled by the stitch cam 25*b*, the needle 4 of the rear needle bed 3 is not pulled out.

The stitch of the loop (N in the left side of FIG. 5) is not tightened upon inversion of the direction of the yarn fed from the yarn feeder 4 accompanied with the inversion of the carriage 5.

When the fabric formation using the front needle bed 3 has been finished to be out of the knitting area (upper right in the drawing), the carriage 5 is inverted again to slide from the right to the left to form the fabric using the front needle bed 3 in the forward stroke.

The fabrication formation in the forward and the return strokes are alternately performed repeatedly.

In the case where the aforementioned operation is repeatedly performed at both ends of the fabric, when the weft-knitting machine is used to produce the tubular knitted fabric by feeding the yarn to the needle 4 of the front and rear needle beds 3 cyclically, the tension force applied to the yarn is intensified upon inversion of the direction for feeding the yarn from the yarn feeder 34 accompanied with the inversion of the carriage 5. Even if the yarn is pulled out from the loop formed just before the inversion to tighten the loop, the tightened loop may be corrected to make the loop length of the fabric uniform.

In the embodiment, while the needle 4 engaging with the loop in the knitted fabric formed just before the inversion of the carriage 5 is used for forming the knitted fabric by feeding the yarn to the opposite needle 4, the needle 4 opposite the one at the end of the knitted fabric is pulled by the operation cam (pull-down cam) 37 of the needle. The structure is not limited to the one as described above. The needle engaging with the loop (N in the right side of FIG. 5) formed lastly on the knitted fabric by one of the needle beds just before inversion of the carriage can be pulled down by the leading stitch cam of the carriage of the other needle bed before feeding the yarn to the needle of the other opposite needle bed. When the direction for feeding the yarn from the yarn feeder 34 is inverted accompanied with the inversion of the carriage 5, the tension force applied to the yarn is intensified. As a result, the yarn is pulled out from the loop formed just before the inversion. The tightened loop may be corrected so as to allow the knitted fabric to have the uniform loop length.

In the aforementioned case, the stitch cam at the leading side of the carriage at the other needle bed may serve as the pull-down cam.

In the case where the stitch cam is allowed to serve as the pull-down cam, it is preferably to use it as the operation cam too.

Besides, in the first embodiment, the needle engaging with the loop lastly formed on the knitted fabric by one of the needle beds just before the inversion of the carriage is pulled down by the stitch cam. Further, in the second embodiment, the stitch cam at the leading side and the pull-down cam are used to pull down the needle as a preferred form, whereas the pull-down cam could be operated solely to pull down the needle so as to suppress tightening of the stitch of the loop lastly formed on the knitted fabric by the one of the needle beds just before inversion of the carriage.

The number of the needle for forming the loop in the knitted fabric just before the inversion of the carriage 5 so as to be pulled down by the pull-down cam is not limited to one but a plurality of needles may be pulled.

The operation cam is not limited to the fixed one, but may be structured to have the height adjustable. In the aforementioned case, the minute setting in accordance with the gauge of the weft-knitting machine, the type of the knitting yarn and the like may be performed.

The invention claimed is:

1. A method for producing a tubular knitted fabric with a weft-knitting machine:

the weft-knitting machine comprising at least one pair of front and rear needle beds disposed both upper end portions thereof confronting each other at a distance;

at least one pair of carriages each one of which is arranged to slide and reciprocate laterally on the respective needle beds; and a composite cam system installed in each carriage, in which the needle being selected from a plural needles mounted in the respective needle beds, is raised and lowered through a composite cam system mounted in the respective carriages for producing a tubular knitted fabric while each carriage being moved reciprocally along the respective needle beds, wherein when a knitting course of the knitted fabric being progressed after inversion of the carriage on one of the needle beds, the needle engaging with at least a lastly formed loop in the knitted fabric just before the inversion of the carriage, is kept from advancing towards the upper portion of the needle bed by means of a stitch cams of the composite cam system installed into the carriage, while on the other needle bed, a knit yarn is fed to a needle opposing to the needle engaged with the last formed loop for forming a continuous loop with the last formed loop.

2. The method for producing a tubular knitted fabric with a weft-knitting machine according to claim 1, wherein the needle engaging with at least a lastly formed loop in the knitted fabric on one of the needle beds just before the inversion of the carriage is pulled down on the needle bed by means of a stitch cams of the composite cam system installed into the carriage, while on the other needle bed, a knit yarn is fed to a needle opposing to the needle engaged with the last formed loop for forming a continuous loop with the last formed loop.

3. The method for producing a tubular knitted fabric with a weft-knitting machine according to claim 1, wherein the needle engaging with at least a lastly formed loop in the knitted fabric on one of the needle beds just before the inversion of the carriage is kept from advancing towards the upper portion of the needle bed by means of a following one of stitch cams of the composite cam system installed into the carriage so that, on the other needle bed, a needle opposing to the needle engaged with the last formed loop before forming a continuous loop with the last formed loop is pulled by a pull-down cam at a forward position.

4. The method for producing a tubular knitted fabric with a weft-knitting machine according to claim 3, wherein the pull-down cam is composed of a needle raising cam in the composite cam system.

5. The method for producing a tubular knitted fabric with a weft-knitting machine according to claim 3, wherein the pull-down cam is composed of a preceding one of stitch cams in the composite cam system.

6. A weft-knitting machine comprising:

at least one pair of front and rear needle beds disposed confronting each other at a distance;

at least one pair of carriages each one of which is arranged to slide and reciprocate laterally on the respective needle beds; and a composite cam system installed in each carriage, in which the needle being selected from a plural needles mounted in the respective needle beds, is raised and lowered through a composite cam system mounted in the respective carriages for producing a tubular knitted fabric with feeding a knit yarn to the needles of the needle beds cyclically, while each carriage being moved reciprocally along the respective needle beds, wherein a pull-down cam is incorporated into a needle raising cam of each composite cam system for pulling down the needle engaging with at least a lastly formed loop in the knitted fabric on one of the needle beds just before inversion of the carriage for progressing a knitting course of the knitted fabric subsequent to the inversion of the carriage.

7. The method for producing a tubular knitted fabric with a weft-knitting machine according to claim 2, wherein the needle engaging with at least a lastly formed loop in the knitted fabric on one of the needle beds just before the inversion of the carriage is kept from advancing towards the upper portion of the needle bed by means of a following one of stitch cams of the composite cam system installed into the carriage so that, on the other needle bed, a needle opposing to the needle engaged with the last formed loop before forming a continuous loop with the last formed loop is pulled by a pull-down cam at a forward position.

* * * * *